US011198987B2

(12) United States Patent
Metzger et al.

(10) Patent No.: US 11,198,987 B2
(45) Date of Patent: Dec. 14, 2021

(54) HYDRAULIC CIRCUIT FOR A SWING SYSTEM IN A MACHINE

(71) Applicant: Caterpillar Inc., Peoria, IL (US)

(72) Inventors: Rustin Glenn Metzger, Congerville, IL (US); Adam Martin Nackers, Hyogo (JP); Joshua Aaron Fossum, Peoria, IL (US); Christopher M. Ruemelin, Morton, IL (US); Corey Lee Gorman, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/858,367

(22) Filed: Apr. 24, 2020

(65) Prior Publication Data

US 2021/0332559 A1 Oct. 28, 2021

(51) Int. Cl.

| | |
|---|---|
| ***E02F 9/22*** | (2006.01) |
| ***F15B 15/02*** | (2006.01) |
| *E02F 9/20* | (2006.01) |

(52) U.S. Cl.

CPC ..... *E02F 9/2225* (2013.01); *F15B 15/02* (2013.01); *E02F 9/2029* (2013.01)

(58) Field of Classification Search

CPC .... E02F 9/2225; F04B 49/002; F16H 61/433; F15B 15/02

See application file for complete search history.

(56) References Cited

U.S. PATENT DOCUMENTS

| | | | |
|---|---|---|---|
| 3,807,174 A | 4/1974 | Wagenseil et al. | |
| 7,797,934 B2 | 9/2010 | Bacon et al. | |
| 9,309,645 B2 * | 4/2016 | Yamamoto | F04B 49/06 |
| 9,879,403 B2 | 1/2018 | White et al. | |
| 10,024,341 B2 | 7/2018 | Zhang et al. | |
| 2016/0032949 A1 | 2/2016 | Ueda et al. | |

(Continued)

FOREIGN PATENT DOCUMENTS

| | | |
|---|---|---|
| JP | 2015090194 A | 5/2015 |
| JP | 2017044262 A | 3/2017 |

(Continued)

OTHER PUBLICATIONS

Written Opinion and International Search Report for Int'l. Patent Appln. No. PCT/US2021/022040, dated Jun. 25, 2021 (12 pgs).

*Primary Examiner* — Abiy Teka

(74) *Attorney, Agent, or Firm* — Harrity & Harrity LLP

(57) ABSTRACT

A hydraulic circuit is disclosed. The hydraulic circuit may include a hydrostatic pump to provide, at a flow rate, a fluid to a hydraulic motor, wherein the hydrostatic pump has a displacement, and wherein the hydraulic motor drives a swinging element; a swing circuit pressure sensor to sense a circuit pressure of the hydraulic circuit; a pilot pressure actuator to control, based on a supply pressure, the displacement of the hydrostatic pump; a pilot pressure override valve to control the supply pressure; and a controller configured to adjust, based on sensed signals and with the pilot pressure override valve, the supply pressure, wherein the sensed signals include: a circuit pressure signal based on the circuit pressure sensed by the swing circuit pressure sensor; and a sensed swing speed signal based on a swing speed of the swinging element sensed by one or more machine sensors.

11 Claims, 3 Drawing Sheets

(56) References Cited

U.S. PATENT DOCUMENTS

| | | | |
|---|---|---|---|
| 2018/0373275 | A1 | 12/2018 | Beschorner et al. |
| 2019/0112786 | A1 | 4/2019 | Nishikawa et al. |
| 2020/0040553 | A1 | 2/2020 | Shirouzu et al. |
| 2020/0378284 | A1 | 12/2020 | Hirozawa et al. |

FOREIGN PATENT DOCUMENTS

| | | | |
|---|---|---|---|
| JP | 2019-167896 | A | 10/2019 |
| KR | 10-2019-0002055 | A | 1/2019 |

* cited by examiner

HYDRAULIC CIRCUIT FOR A SWING SYSTEM IN A MACHINE

TECHNICAL FIELD

The present disclosure relates generally to a hydraulic circuit and, for example, to a hydraulic circuit for a swing system in a machine.

BACKGROUND

Swing-type excavation machines, for example hydraulic excavators and front shovels, may be used for transferring material from a dig location to a dump location. These machines generally utilize one or more systems (e.g., a swing system, an implement system, and/or the like) that may require hydraulic pressure and flow to perform an action. For example, a swing system may include a power-source driven pump providing pressurized fluid through a swing motor to rotate an upper carriage of the machine relative to an undercarriage of the machine. Such machines may include a controller to control, based on signals from one or more input components receiving operator commands, a power-source (e.g., an engine and/or the like) for driving the pump such that the pump provides pressurized fluid to the swing motor to rotate the upper carriage as commanded by the operator.

When the operator commands the upper carriage to increase rotation speed, the controller may command the power-source to drive the pump to increase the flow of fluid to the swing motor, which increases pressure in a hydraulic circuit including the pump and the swing motor. To prevent damaging components of the hydraulic circuit (e.g., the pump, the swing motor, and/or the like), a relief valve may be included in the hydraulic circuit, such that, when pressure in the hydraulic circuit satisfies a threshold, the pressure relief valve opens to divert fluid and reduce pressure in the hydraulic circuit.

To generate sufficient pressure and flow within the hydraulic circuit to respond to operator commands to increase rotation speed of the upper carriage, the controller may command the power-source to drive the pump to increase the flow of fluid to the swing motor which increases the pressure in the hydraulic circuit and causes the pressure relief valve to open. Similarly, when an operator provides a command to decrease rotation speed and/or stop rotation of the upper carriage, the momentum of the upper carriage may drive the swing motor, which increases the pressure in the hydraulic circuit and causes the pressure relief valve to open. However, each time the pressure relief valve opens, at least a portion of the flow of the fluid is wasted. Thus, increasing and decreasing the rotation speed of the upper carriage may reduce efficiency of the machine (e.g., because the flow of the fluid is wasted, because the energy consumed by the power source driving the pump to generate the flow of fluid is wasted, and/or the like).

One attempt to increase efficiency of a machine and reduce wasted fluid flow is disclosed in Japanese Patent Publication No. 2017044262 ("the '262 publication") filed by Hitachi Construction Machine Co. Ltd. and published Mar. 2, 2017. In particular, the '262 publication discloses that when a discharge circuit of a hydraulic pump has a plurality of set pressures as a set pressure of a relief valve, it is possible to efficiently and reliably recover energy discarded to a tank when discharging pressure oil from the relieve valve. The '262 publication discloses that discharge circuits of hydraulic pumps have a plurality of set pressures as set pressures of relief valves, and a plurality of accumulators having different set values of minimum operating pressures of hydraulic pumps according to the set pressures of the first and second recovery valves that shut off/open recovery oil passages and the relief valves.

While the '262 publication may disclose discharge circuits of hydraulic pumps that have a plurality of accumulators having different set values of minimum operating pressures of hydraulic pumps according to the set pressures of the first and second recovery valves that shut off/open recovery oil passages and the relief valves, the '262 publication does not address the reduced efficiency problem set forth above.

The hydraulic circuit for a swing system of the present disclosure solves one or more of the problems set forth above and/or other problems in the art.

SUMMARY

According to some implementations, a hydraulic circuit may comprise a hydrostatic pump to provide, at a flow rate, a fluid to a hydraulic motor, wherein the hydrostatic pump has a displacement, and wherein the hydraulic motor drives a swinging element; a swing circuit pressure sensor to sense a circuit pressure of the hydraulic circuit; a pilot pressure actuator to control, based on a supply pressure, the displacement of the hydrostatic pump; a pilot pressure override valve to control the supply pressure; and a controller configured to adjust, based on sensed signals and with the pilot pressure override valve, the supply pressure, wherein the sensed signals include: a circuit pressure signal based on the circuit pressure sensed by the swing circuit pressure sensor; and a sensed swing speed signal based on a swing speed of the swinging element sensed by one or more machine sensors.

According to some implementations, an excavator may comprise a swinging element; one or more input components configured to generate command signals to control the swinging element; a swing speed sensor configured to generate a sensed swing speed signal; a hydraulic motor configured to drive the swinging element; a hydrostatic pump to provide, at a flow rate, a fluid to the hydraulic motor, wherein the hydrostatic pump has a displacement; a swing circuit pressure sensor to sense a circuit pressure of a hydraulic circuit including the hydraulic motor and the hydrostatic pump; a pilot pressure actuator to control, based on a supply pressure, the displacement of the hydrostatic pump; a pilot pressure override valve to control the supply pressure; and a controller configured to adjust, with the pilot pressure override valve and based on the sensed swing speed signal and the circuit pressure, the supply pressure.

According to some implementations, an excavator may comprise a swinging element; a swing speed sensor configured to generate, based on a swing speed of the swinging element, a sensed swing speed signal; a hydraulic motor configured to drive the swinging element; a hydrostatic pump to provide, at a flow rate, a fluid to the hydraulic motor, wherein the hydrostatic pump has a displacement; a swing circuit pressure sensor to sense a circuit pressure of a hydraulic circuit including the hydraulic motor and the hydrostatic pump; a pilot pressure actuator to control, based on a supply pressure, the displacement of the hydrostatic pump; a pilot pressure override valve to control the supply pressure; an engine configured to drive the hydrostatic pump; and a controller configured to: adjust, with the pilot pressure override valve and based on the sensed swing speed signal and the circuit pressure, the supply pressure; control the engine to adjust the flow rate at which the hydrostatic pump provides the fluid; and control, based on a command signal to decrease swing speed, the engine to adjust the flow rate to zero, wherein, when the swing speed decreases, the hydraulic motor provides the fluid to the hydrostatic pump, and wherein, when the hydraulic motor provides the fluid to the hydrostatic pump, the fluid drives the hydrostatic pump to provide energy to at least one of the engine or an energy storage system.

DETAILED DESCRIPTION

This disclosure relates to a hydraulic circuit for a swing system. The hydraulic circuit has universal applicability to machines utilizing a swing system. The term "machine" may refer to any machine that performs an operation associated with an industry such as, for example, mining, construction, farming, transportation, or another industry. Moreover, one or more implements may be connected to the machine.

Figure 1:
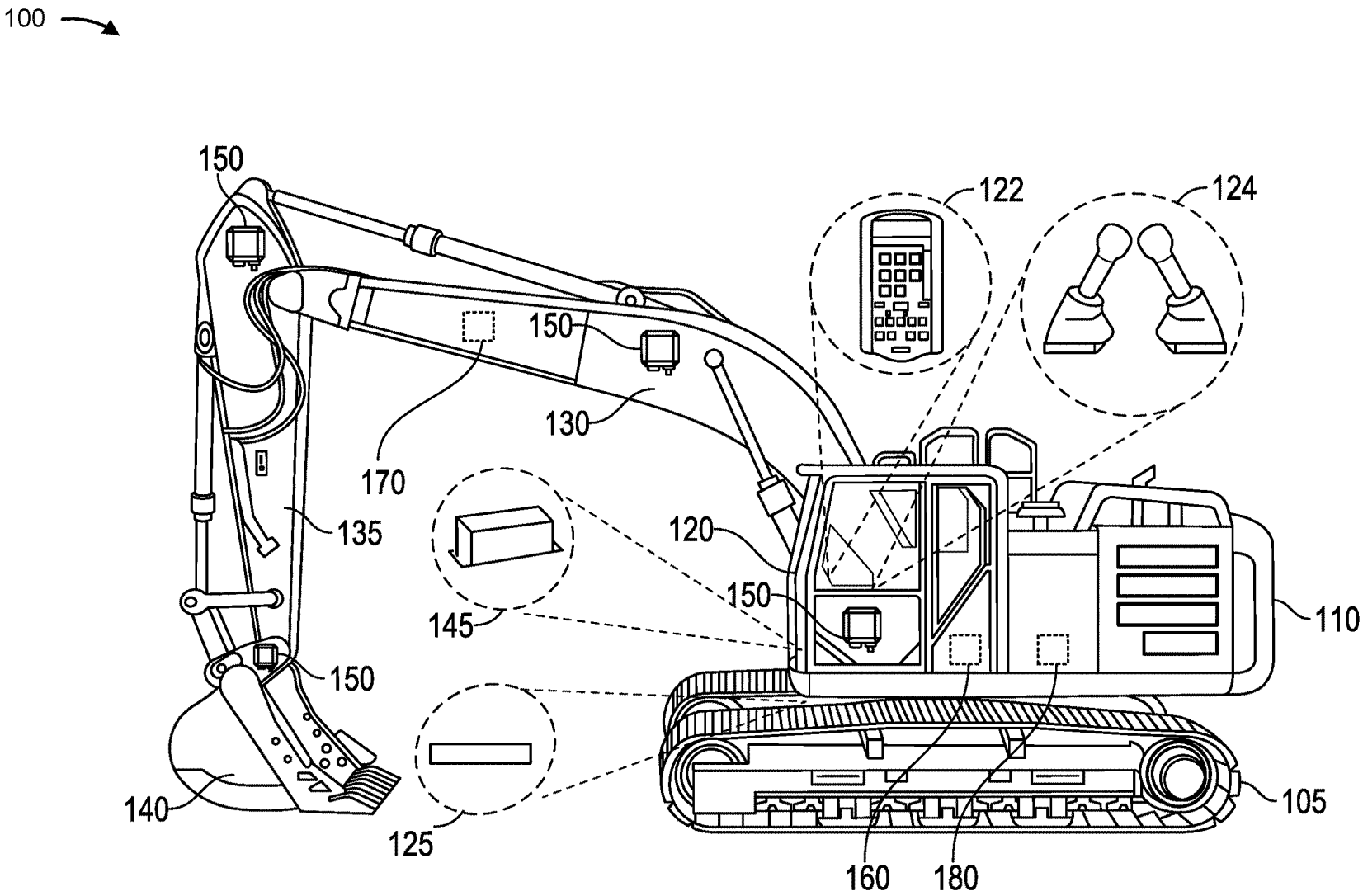
FIG. 1 is diagram of an example machine described herein.

FIG. 1 is a diagram of an example machine 100 described herein. As shown in FIG. 1, machine 100 is embodied as an earth moving machine, such as an excavator. Alternatively, the machine 100 may be a haul truck, a dozer, a loader, a backhoe, a motor grader, a wheel tractor scraper, another earth moving machine, and/or the like.

As shown in FIG. 1, machine 100 includes ground engaging members 105, such as tracks (as shown in FIG. 1), wheels, rollers, and/or the like, for propelling machine 100. Ground engaging members 105 are mounted on a machine body (not shown) and are driven by one or more engines and drive trains (not shown). The car body supports a rotating frame (not shown). Machine 100 further includes a machine body 110 and an operator cabin 120. Machine body 110 is mounted on the rotating frame. Operator cabin 120 is supported by machine body 110 and the rotating frame. Operator cabin 120 includes an integrated display 122 and operator controls 124, such as, for example, integrated joystick. Operator controls 124 may include one or more input components, including, for example, a first input component configured to generate a directional swing signal based on directional operator input and a commanded swing speed signal based on swing speed operator input. The one or more input components may further include a second input component configured to generate a torque signal. For an autonomous machine, operator controls 124 may not be designed for use by an operator and, rather, may be designed to operate independently from an operator. In this case, for example, operator controls 124 may include one or more input components that provide an input signal (e.g., a directional swing signal, a torque signal, and/or the like) for use by another component without any operator input.

As shown in FIG. 1, machine 100 includes a swivel element 125. Swivel element 125 may include one or more components that enable the rotating frame to rotate (or swivel). For example, swivel element 125 may enable the rotating frame to rotate (or swivel) with respect to ground engaging members 105.

As shown in FIG. 1, machine 100 includes a boom 130, a stick 135, and a tool 140. Boom 130 is pivotally mounted at a proximal end of machine body 110, and is articulated relative to machine body 110 by one or more fluid actuation cylinders (e.g., hydraulic or pneumatic cylinders), electric motors, and/or other electro-mechanical components. Stick 135 is pivotally mounted at a distal end of boom 130 and is articulated relative to boom 130 by the one or more fluid actuation cylinders, electric motors, and/or other electro-mechanical components. Tool 140 is mounted at a distal end of stick 135 and may be articulated relative to stick 135 by the one or more fluid actuation cylinders, electric motors, and/or other electro-mechanical components. Tool 140 may be a bucket (as shown in FIG. 1) or any other tool that may be mounted on stick 135. Machine body 110, boom 130, stick 135, and/or tool 140 may be included in or be a part of a swinging element of machine 100. Operator controls 124 may generate command signals to control the swinging element.

As shown in FIG. 1, machine 100 includes a controller 145 (e.g., an electronic control module (ECM)), one or more inertial measurement units (IMUs) 150 (referred to herein individually as "IMU 150," and collectively referred to collectively as "IMUs 150"), and one or more sensors. Controller 145 may control and/or monitor operations of machine 100. For example, controller 145 may control and/or monitor the operations of machine 100 based on signals from IMUs 150, signals from the one or more sensors of machine 100, signals from operator controls 124, and/or the like.

As shown in FIG. 1, IMUs 150 are installed at different positions on components or portions of machine 100, such as, for example, on machine body 110, boom 130, stick 135, and tool 140. An IMU 150 includes one or more devices that are capable of receiving, generating, storing, processing, and/or providing signals indicating a position and orientation of a component, of machine 100, on which the IMU 150 is installed. For example, IMU 150 may include one or more accelerometers and/or one or more gyroscopes. The one or more accelerometers and/or the one or more gyroscopes generate and provide signals that can be used to determine a position and orientation of the IMU 150 relative to a frame of reference and, accordingly, a position and orientation of the component.

The one or more sensors of machine 100 (machine sensors) may include a swing speed sensor 160, an implement circuit pressure 170, and/or a swing circuit pressure sensor 180. Swing speed sensor 160 may include one or more devices (e.g., sensor devices) that are capable of sensing a speed of a swing (or swing speed) of the swinging element of machine 100 and generating a sensed swing speed signal indicating the sensed swing speed of the swinging element. Swing speed sensor 160 may include an inertial sensor installed on the swinging element. Additionally, or alternatively, swing speed sensor 160 may include a motor speed sensor configured to generate the sensed swing speed signal. The motor speed sensor may be provided on a hydraulic motor (not shown) of machine 100 that is configured to drive the swinging element. Additionally, or alternatively, swing speed sensor 160 may include a swivel position sensor configured to generate the sensed swing speed signal. The swivel position sensor may be provided on swivel element 125.

Implement circuit pressure sensor 170 may include one or more sensor devices that are capable of sensing a pressure (e.g., fluid pressure) of an implement circuit of machine 100 and generating a signal indicating the pressure (e.g., the fluid pressure) of the implement circuit. The implement circuit may comprise one or more implements of machine 100. The implement pressure may correspond to a pressure of fluid supplied to operate the one or more implements. Swing circuit pressure sensor 180 may include one or more sensor devices that are capable of sensing a pressure (e.g., a fluid pressure) of a hydraulic circuit of machine 100 and generating a signal indicating the pressure (e.g., the fluid pressure) of the hydraulic circuit. The hydraulic circuit may comprise one or more hydraulic motors of machine 100. The circuit pressure may correspond to a pressure of fluid supplied to operate (or drive) the one or more hydraulic motors. The hydraulic circuit may be used to control the swinging element. The implement circuit pressure sensor, the implement circuit, the swing circuit pressure sensor, the hydraulic motor, and the hydraulic circuit are discussed in more detail below.

As indicated above, FIG. 1 is provided as an example. Other examples may differ from what was described in connection with FIG. 1.

Figure 2:
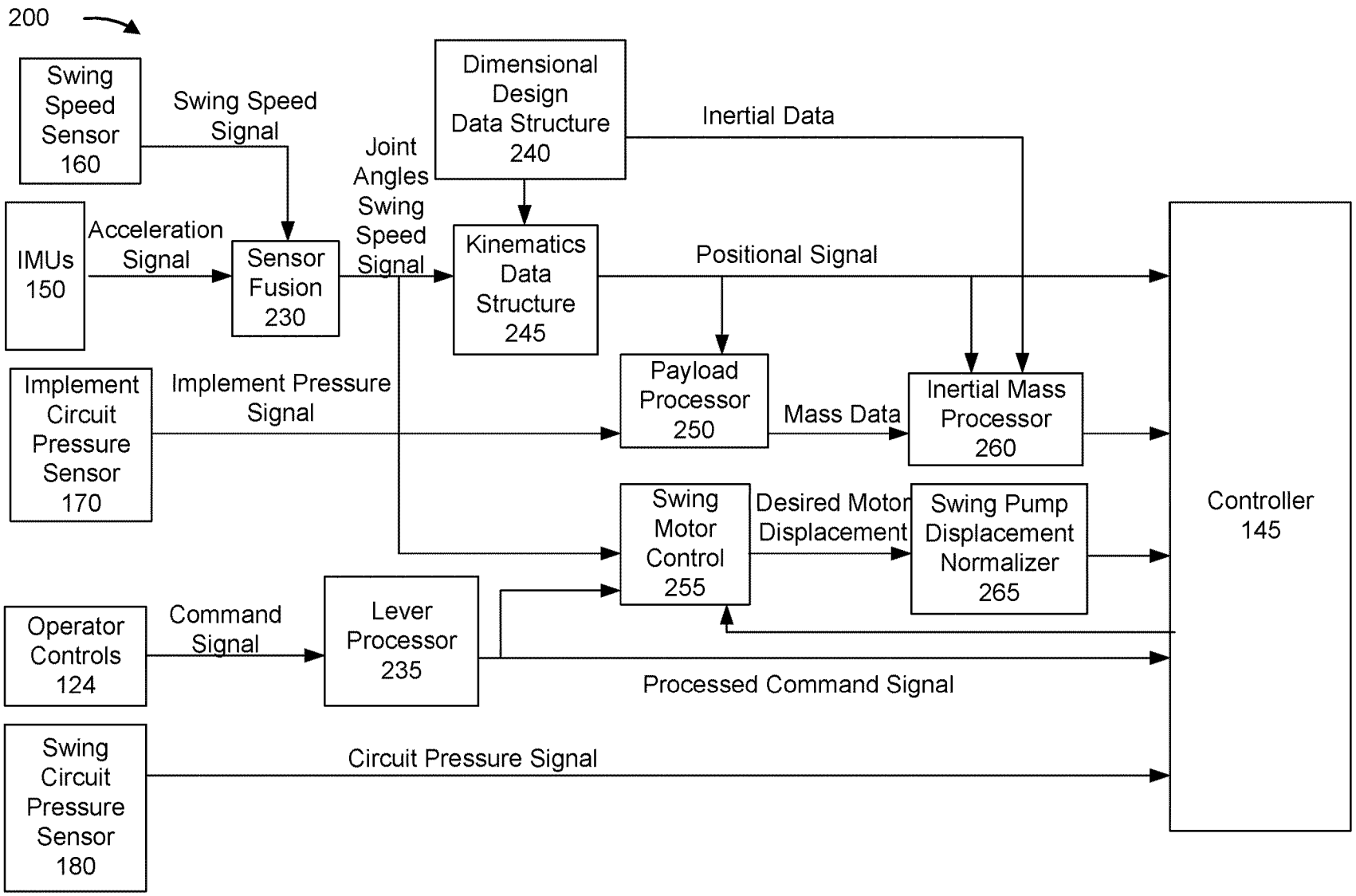
FIG. 2 is a block diagram of an example system for controlling an operation of the machine of FIG. 1 described herein.

FIG. 2 is a block diagram of an example system 200 for controlling an operation of machine 100 of FIG. 1. For example, system 200 may be used to control an operation of the swinging element. As shown in FIG. 2, system 200 includes operator controls 124, controller 145, IMUs 150, swing speed sensor 160, implement circuit pressure sensor 170, and swing circuit pressure sensor 180. System 200 further includes sensor fusion 230, lever processor 235, dimensional design data structure 240, kinematics data structure 245, payload processor 250, swing motor control 255, inertial mass processor 260, and swing pump displacement normalizer 265. As shown in FIG. 2, controller 145 receives signals (e.g., input signals) that are to be used to control the swinging element of machine 100. The signals may include and/or may be based on signals generated by operator controls 124, IMUs 150, swing speed sensor 160, implement circuit pressure sensor 170, and/or swing circuit pressure sensor 180.

As shown in FIG. 2, operator controls 124 generate a command signal based on input from an operator (or operator input) or without the operator input (in the case of an autonomous machine). The command signal may be generated to control the swinging element. For example, controller 145 may be configured to adjust a supply pressure (of fluid) in the hydraulic circuit of machine 100 based on the command signal. The command signal may include a torque signal based on a torque command provided by operator controls 124. Additionally, or alternatively, the command signal may include a commanded swing speed signal based on a swing speed command provided by operator controls 124.

The command signal may be provided to lever processor 235. Lever processor 235 includes one or more devices that are capable of processing command signals from operator controls 124. Lever processor 235 may process the command signal to adjust the command signal and generate a processed command signal to provide to controller 145. The command signal may be processed based on one or more characteristics of operator controls 124, such as, for example, a sensitivity level of operator controls 124.

As shown in FIG. 2, the processed command signal may be provided to swing motor control 255. Swing motor control 255 includes one or more devices that are capable of determining a desired displacement of a hydraulic motor driving a movement (e.g., a swing) of the swinging element, based on a command signal of operator controls 124. Swing motor control 255 may determine a desired motor displacement signal indicating a desired displacement of the hydraulic motor. As shown in FIG. 2, the desired motor displacement signal may be provided to swing pump displacement normalizer 265. Swing pump displacement normalizer 265 includes one or more devices that are capable of generating a swing pump displacement signal based on the desired motor displacement signal. The swing pump displacement signal causes a displacement of a hydraulic pump that provides fluid to the hydraulic motor.

As shown in FIG. 2, swing speed sensor 160 generates a swing speed signal indicating a swing speed (or a speed of a swing) of the swinging element of machine 100. As explained above, the swing element includes machine body 110, boom 130, stick 135, and/or tool 140. IMU 150 generates an acceleration signal indicating an acceleration of the swing of the swinging element. The acceleration signal and the swing speed signal may be combined and processed using sensor fusion 230 to generate a joint angles swing speed signal. Sensor fusion 230 includes one or more devices that are capable of combining signals from one or more sensors and one or more IMUs 150. Joint angles swing speed signal may indicate the swing speed of angles of joints of the swinging element (e.g., an angle between boom 130 and stick 135, an angle between stick 135 and tool 140, and/or the like). As shown in FIG. 2, the joint angles swing speed signal may be combined with information from dimensional design data structure 240 and information from kinematics data structure 245 to generate a positional signal associated with the one or more IMUs 150 (e.g., positional signal associated with the swing element). For example, the positional signal may indicate a position of the one or more IMUs 150 and may be provided to controller 145. Dimensional design data structure 240 is stored in a memory device and may include information indicating dimensions and structure of machine 100. The information may be used to derive dynamics and kinematics associated with machine 100. Kinematics data structure 245 is stored in a memory device and may include information regarding kinematics associated with machine 100.

As shown in FIG. 2, implement circuit pressure sensor 170 may generate an implement pressure signal indicating a sensed implement pressure associated with the implement circuit. As explained above, the implement pressure signal indicates a pressure of fluid supplied to operate the one or more implements of machine 100. The implement pressure signal may be provided to payload processor 250 to generate mass data associated with a payload of machine 100. The payload may include an amount of material being lifted, moved, and/or worked by one or more implements of machine 100. Payload processor 250 includes one or more devices that are capable of processing the implement pressure signal and the positional signal to generate the mass data associated with the payload. As shown in FIG. 2, the mass data may be provided to inertial mass processor 260 to generate an inertial mass signal associated with machine 100. Inertial mass processor 260 includes one or more devices that are capable of processing the mass data with the positional signal and the inertial data to generate the inertial mass signal. The inertial mass signal may indicate an inertial mass of machine 100 and may be provided to controller 145.

As shown in FIG. 2, swing circuit pressure sensor 180 may generate a circuit pressure signal (or sensed circuit pressure signal) indicating the sensed circuit pressure of the hydraulic circuit. The circuit pressure signal may be provided to controller 145. As mentioned above, controller 145 may use one or more of the signals, mentioned herein, to control operations of machine 100, as described below in connection with FIG. 3.

As indicated above, FIG. 2 is provided as an example. Other examples may differ from what was described in connection with FIG. 2.

Figure 3:
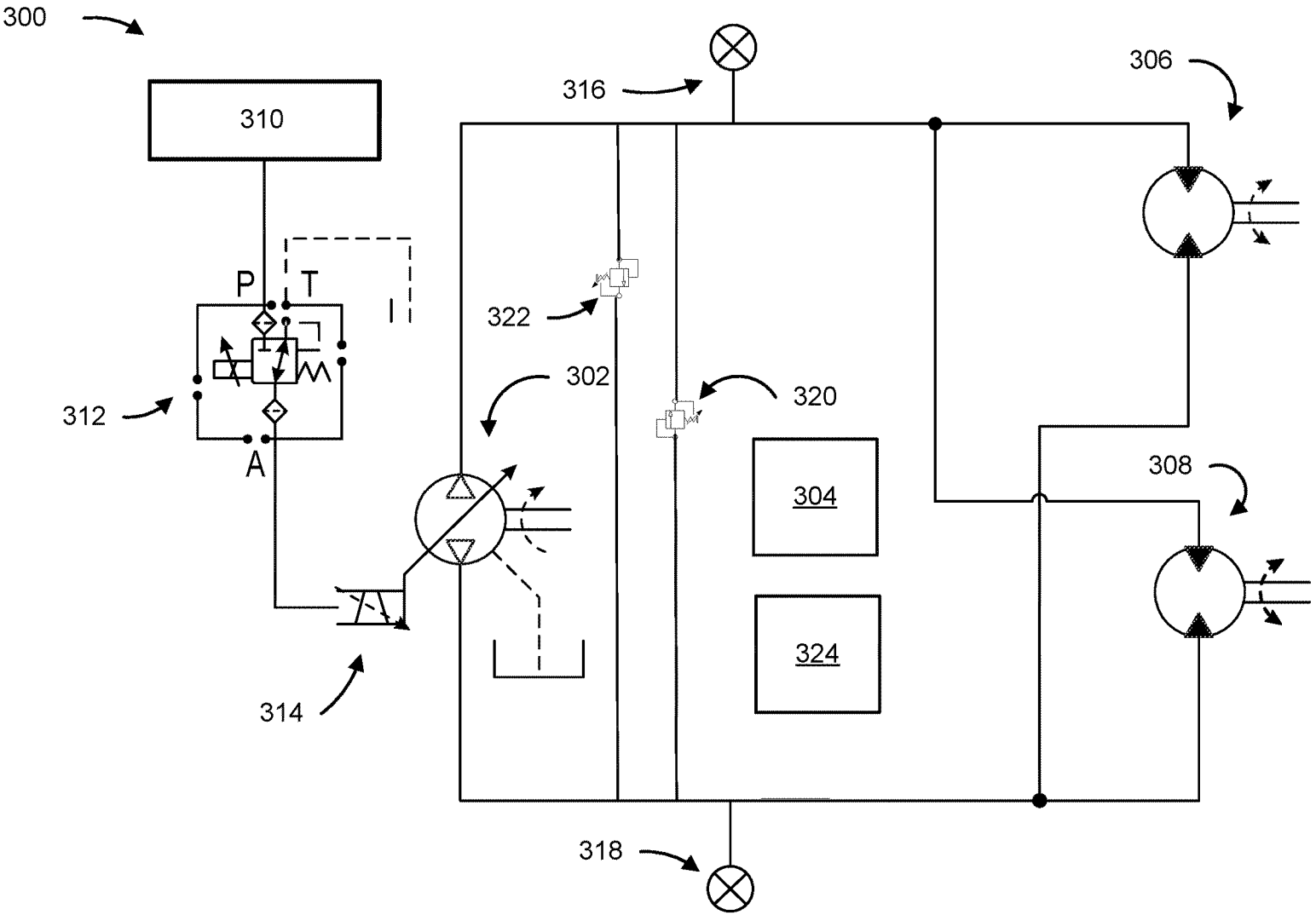
FIG. 3 is a diagram of an example hydraulic circuit of the machine of FIG. 1.

FIG. 3 is a diagram of an example hydraulic circuit 300 of machine 100 of FIG. 1. As shown in FIG. 3, hydraulic circuit 300 includes a hydrostatic pump 302, an engine 304, a hydraulic motor 306 (or first hydraulic motor 306), a hydraulic motor 308 (or second hydraulic motor 308), a pilot supply 310, a pilot pressure override valve 312, a pilot pressure actuator 314, a swing circuit pressure sensor 316 (or first swing circuit pressure sensor 316), a swing circuit pressure sensor 318 (or second swing circuit pressure sensor 318), a relief valve 320, and a relief valve 322. In some implementations, hydraulic circuit 300 may include energy storage system 324.

Hydrostatic pump 302 includes a pump with a displacement that is variable (or a variable displacement). Hydrostatic pump 302 is configured to provide, at a flow rate, a fluid to hydraulic motor 306 and/or hydraulic motor 308 (e.g., to drive the swinging element). Hydrostatic pump 302, in conjunction with controller 145, is configured to adjust the flow rate based on a command signal generated by operator controls 124. For example, controller 145 is configured to, based on a command signal to adjust the swing speed of the swinging element, cause hydrostatic pump 302 to adjust the flow rate. Hydrostatic pump 302 is configured to supply fluid to hydraulic motor 306 and/or hydraulic motor 308 in a closed loop system.

Hydrostatic pump 302 is configured to be actuated to supply the fluid based on torque control as well as speed control for optimum swing actuation of the swinging element. For example, hydrostatic pump 302 is configured to be actuated based on command signals generated (by operator controls 124) to control the swinging element. For instance, hydrostatic pump 302 is configured to be actuated based on one or more command signals including, for example, a directional swing signal, a torque signal, and/or a swing speed signal.

More particularly, hydrostatic pump 302 is configured as a displacement-controlled pump, where the displacement of hydrostatic pump 302 is controlled based on the application of a supply pressure (e.g., from pilot supply 310) applied to pilot pressure actuator 314, as a result of the command signals generated by operator controls 124. Pilot pressure actuator 314 is configured to increase (or upstroke) the displacement of hydrostatic pump 302 as the supply pressure increases.

For example, during a deceleration of a movement (e.g., swinging) of the swinging element (based on command signals generated by operator controls 124), the displacement of hydrostatic pump 302 remains increased (or upstroked). In this manner, hydrostatic pump 302 may act as a motor to convert the increased fluid pressure, produced by the deceleration, to shaft torque for engine 304 (or torque for engine shaft of engine 304). Accordingly, hydrostatic pump 302 may be configured to convert hydraulic energy (applied to hydrostatic pump 302 by way of the fluid pressure) into mechanical energy and to provide such mechanical energy to engine 304 and/or to one or more other power sources connected to hydrostatic pump 302. The one or more power sources may provide the mechanical energy to other systems associated with machine 100 or to a flywheel for storage. For example, hydrostatic pump 302 may provide the mechanic energy as power to a linkage of machine 100, such as, for example, a front linkage of machine 100.

In other words, during deceleration of the swinging element and/or during a braking event of machine 100, hydrostatic pump 302 is configured to recover energy. In this regard, controller 145 (e.g., based on command signals generated by operator controls 124) executes a feedback control (e.g., using the command signals) such that hydrostatic pump 302 is operated in a displacement/torque-controlled mode. For example, controller 145 may control, based on a command signal to decrease swing speed, hydrostatic pump 302 and hydraulic motor 308 to provide (or achieve) a braking torque (e.g., a maximum braking torque). Hydrostatic pump 302 may recover energy while the braking torque is being provided (or is being achieved). The braking torque may cause a deceleration of the swinging element (e.g., deceleration of a movement of the swinging element) and/or a braking event of machine 100.

Engine 304 is an engine that is configured to drive hydrostatic pump 302. Engine 304 may include an internal combustion engine, an electric motor, a hybrid engine, and/or the like.

Hydraulic motor 306 is a hydraulic motor that is configured to drive the swinging element (e.g., based on the fluid provided by hydrostatic pump 302). For example, hydraulic motor 306 is configured to engage a drive mechanism (not shown) on the swinging element. When a command signal is generated (by operator controls 124) to decrease a swing speed of the swinging element, hydraulic motor 306 may provide the fluid to hydrostatic pump 302. When hydraulic motor 306 provides the fluid to hydrostatic pump 302, the fluid drives hydrostatic pump 302 to provide energy to engine 304 and/or an energy storage system 324. Hydraulic motor 306 may be a fixed displacement motor or a variable displacement motor. Energy storage system 324 may include one or more energy storage devices configured to store energy.

Hydraulic motor 308 may be the same as or similar to hydraulic motor 306. In some implementations, hydraulic motor 308 may operate as a backup for hydraulic motor 306 and hydraulic motor 306 may operate as a backup for hydraulic motor 308.

Pilot supply 310 may include one or more components that provide a supply pressure (of fluid) that causes a displacement of hydrostatic pump 302. Pilot pressure override valve 312 is a valve that is configured to control the supply pressure (of fluid) provided by pilot supply 310. For example, pilot pressure override valve 312, in conjunction with controller 145, may control the supply pressure. For instance, controller 145 may be configured to adjust, based on sensed signals and using pilot pressure override valve 312, the supply pressure. The sensed signals include a circuit pressure signal and a swing speed signal (discussed above with respect to FIG. 2). For example, when the sensed signals are indicative of an acceleration of a movement (e.g., swinging) of the swinging element, the sensed signals are used as feedback to cause pilot pressure override valve 312 to operate hydrostatic pump 302 in a pressure/speed-controlled mode. As a result, hydraulic circuit 300 is to maintain an increased displacement and torque of hydrostatic pump 302 while controlling the speed and pressure of hydrostatic pump 302 to responsively achieve a controlled, increased acceleration of the swinging element. This controlled, increased acceleration of the swinging element is achieved without producing excessive pressurized flow of fluid, which is typically discharged and released via a relief valve (e.g., relief valve 320 or relief valve 322) during acceleration of the swinging element.

Controller 145 may further be configured to adjust, using pilot pressure override valve 312, the supply pressure based on the sensed signals, a commanded swing speed signal from operator controls 124, and a torque signal from operator controls 124. As will be explained below, pilot pressure override valve 312 may control operation of hydrostatic pump 302 by adjusting the supply pressure to cause an adjustment of the displacement of hydrostatic pump 302.

Pilot pressure actuator 314 is an actuator that is configured to control, based on a supply pressure, the displacement of hydrostatic pump 302. Pilot pressure actuator 314 may control the displacement of hydrostatic pump 302 in conjunction with controller 145 and pilot pressure override valve 312. For example, controller 145 may be configured to adjust, with pilot pressure override valve 312, the supply pressure to cause pilot pressure actuator 314 to adjust the displacement of hydrostatic pump 302. The supply pressure may be adjusted based on one or more of sensed signals from the machine sensors and/or one or more command signals from operator controls 124. For example, controller 145 may be configured to, based on a circuit pressure signal, adjust, using pilot pressure override valve 312, the supply pressure to cause pilot pressure actuator 314 to adjust the displacement of hydrostatic pump 302. For instance, controller 145 may compare a pressure associated with the circuit pressure signal and a pressure associated with a command signal and may cause the supply pressure to be adjusted to adjust the displacement of hydrostatic pump based on a result of the comparison. As example, controller 145 may be configured to increase, using pilot pressure override valve 312, the supply pressure to cause pilot pressure actuator 314 to increase the displacement of hydrostatic pump 302 when the pressure associated with the circuit pressure signal is less than the pressure associated with the command signal. Conversely, controller 145 may be configured to decrease, using pilot pressure override valve 312, the supply pressure to cause pilot pressure actuator 314 to decrease the displacement of hydrostatic pump 302 when the pressure associated with the circuit pressure signal exceeds the pressure associated with the command signal.

Additionally, or alternatively, controller 145 may be configured to, based on a sensed swing speed signal indicating an increase in the swing speed, adjust, using pilot pressure override valve 312, the supply pressure to cause pilot pressure actuator 314 to adjust the displacement of hydrostatic pump 302. For example, controller 145 may be configured to, based on the sensed swing speed signal indicating an increase in the swing speed, increase, using pilot pressure override valve 312, the supply pressure to cause pilot pressure actuator 314 to increase the displacement of hydrostatic pump 302. Additionally, or alternatively, controller 145 may be configured to, based on a command signal to increase the swing speed, adjust, using pilot pressure override valve 312, the supply pressure to cause pilot pressure actuator 314 to increase the displacement of hydrostatic pump 302. Additionally, or alternatively, controller 145 may be configured to, based on a command signal to increase a torque driving the swinging element, adjust, using pilot pressure override valve 312, the supply pressure to cause pilot pressure actuator 314 to increase the displacement of hydrostatic pump 302. Accordingly, based on a sensed swing speed signal, a sensed circuit pressure, a commanded swing speed signal, and/or a commanded torque signal, controller 145 may be configured to adjust, with pilot pressure override valve 312, the supply pressure to adjust, with pilot pressure actuator 314, the displacement of hydrostatic pump 302 and/or adjust a displacement of hydraulic motor 308 (e.g., if hydraulic motor 308 is a variable displacement motor).

Swing circuit pressure sensor 316 and swing circuit pressure sensor 318 are embodied in and/or include swing circuit pressure sensor 180 which has been described above. Swing circuit pressure sensor 316 may be included in a portion of hydraulic circuit 300 and may be configured to sense a circuit pressure (or first circuit pressure) of fluid in hydraulic circuit 300 when the fluid flows in a first direction through hydraulic circuit 300. Swing circuit pressure sensor 318 may be included in another portion of hydraulic circuit 300 and may be configured to sense a circuit pressure (or second circuit pressure) of fluid in hydraulic circuit 300 when the fluid flows in a second direction (opposite the first direction) through hydraulic circuit 300. The first direction may be a clockwise direction and the second direction may be a counterclockwise direction. Alternatively, the first direction may be a counterclockwise direction and the second direction may be a clockwise direction. In this regard, controller 145 may be configured to adjust, using pilot pressure override valve 312, the supply pressure based on the sensed swing speed signal, the first circuit pressure, and/or the second circuit pressure.

Relief valve 320 is a valve that is configured to reduce the circuit pressure (e.g., the first circuit pressure) when the circuit pressure satisfies a threshold. For example, relief valve 320 may release fluid of hydraulic circuit 300 to reduce the circuit pressure (e.g., the first circuit pressure) to a pressure that satisfies the threshold. Similarly, relief valve 322 is a valve that is configured to reduce the circuit pressure (e.g., the second circuit pressure) when the circuit pressure satisfies a threshold. For example, relief valve 322 may release fluid of hydraulic circuit 300 to reduce the circuit pressure (e.g., the second circuit pressure) to a pressure that satisfies the threshold. In this regard, controller 145 is configured to adjust the supply pressure to prevent the circuit pressure (e.g., the first circuit pressure or the second circuit pressure) from satisfying the threshold. Energy storage system 324 may include one or more energy storage components (e.g., devices) configured to store energy.

In some examples, hydraulic circuit 300 may be implemented without pilot pressure override valve 312. Accordingly, hydraulic circuit 300 may be implemented as a closed-loop control system that adjusts the displacement of hydrostatic pump 302 without using pilot pressure override valve 312. Such closed-loop control system may use the sensed circuit pressure as a feedback signal for a commanded signal (e.g., a commanded swing speed signal, and/or a commanded torque signal) that is used to adjust the displacement of hydrostatic pump 302 (without using pilot pressure override valve 312). For example, based on the commanded signal and the sensed circuit pressure, controller 145 may be configured to adjust the supply pressure to adjust, with pilot pressure actuator 314, the displacement of hydrostatic pump 302 (without using pilot pressure override valve 312).

As indicated above, FIG. 3 is provided as an example. Other examples may differ from what was described in connection with FIG. 3.

INDUSTRIAL APPLICABILITY

The disclosed hydraulic circuit may be used with machines utilizing a swing system. The disclosed hydraulic circuit includes a hydrostatic pump with a variable displacement. The disclosed hydraulic circuit also includes a pilot pressure override valve that controls a supply pressure and a pilot pressure actuator that controls the variable displacement of the hydrostatic pump based on the controlled supply pressure. The disclosed hydraulic circuit further includes an engine that drives the hydrostatic pump to provide a flow of hydraulic fluid to a hydraulic motor.

Several advantages may be associated with the disclosed hydraulic circuit. For example, during a deceleration of a swinging element of a machine and/or during a braking event of the machine, the hydrostatic pump is configured to recover energy. For instance, during the deceleration and/or the braking event, the displacement of the hydrostatic pump remains increased based on increased fluid pressure. In this manner, the hydrostatic pump may act as a motor to convert the increased fluid pressure, produced by the deceleration, to shaft torque for the engine. Accordingly, the hydrostatic pump may convert hydraulic energy (applied to the hydrostatic pump by way of the fluid pressure) into mechanical energy and may provide such mechanical energy to the engine.

As another example, when an acceleration of a movement (e.g., swinging) of the swinging element is sensed, the pilot pressure override valve operates the hydrostatic pump in a pressure/speed-controlled mode. As a result, the hydraulic circuit is to maintain an increased displacement and torque of the hydrostatic pump while controlling the speed and pressure of the hydrostatic pump to responsively achieve a controlled, increased acceleration of the swinging element. This controlled, increased acceleration of the swinging element is achieved without producing excessive pressurized flow of fluid, which is typically discharged and released via a relief valve. Accordingly, by enabling energy recovery during deceleration and by preventing the production of excessive fluid during acceleration, the disclosed hydraulic circuit improves efficiency of the machine (e.g., because the flow of the fluid is not wasted, because the energy consumed by the engine driving the hydrostatic pump to generate the flow of fluid is not wasted, and/or the like).

As used herein, the articles "a" and "an" are intended to include one or more items, and may be used interchangeably with "one or more." Also, as used herein, the terms "has," "have," "having," or the like are intended to be open-ended terms. Further, the phrase "based on" is intended to mean "based, at least in part, on."

The foregoing disclosure provides illustration and description, but is not intended to be exhaustive or to limit the implementations to the precise form disclosed. Modifications and variations may be made in light of the above disclosure or may be acquired from practice of the implementations. It is intended that the specification be considered as an example only, with a true scope of the disclosure being indicated by the following claims and their equivalents. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

What is claimed is:

1. An excavator, comprising:

a swinging element;

one or more input components configured to generate command signals to control the swinging element;

a swing speed sensor configured to generate a sensed swing speed signal;

a hydraulic motor configured to drive the swinging element, wherein the hydraulic motor is a first hydraulic motor configured to engage a drive mechanism on the swinging element;

a second hydraulic motor configured to engage the drive mechanism on the swinging element;

a hydrostatic pump to provide, at a flow rate, a fluid to the hydraulic motor, wherein the hydrostatic pump has a displacement;

a swing circuit pressure sensor to sense a circuit pressure of a hydraulic circuit including the hydraulic motor and the hydrostatic pump;

a pilot pressure actuator to control, based on a supply pressure, the displacement of the hydrostatic pump;

a pilot pressure override valve to control the supply pressure; and a controller configured to adjust, with the pilot pressure override valve and based on the sensed swing speed signal and the circuit pressure, the supply pressure.

2. The excavator of claim 1, wherein the swing speed sensor comprises one or more devices configured to configured to sense a swing speed of the swinging element and to generate, based on the swing speed of the swinging element, the sensed swing speed signal.

3. The excavator of claim 1, wherein the swing circuit pressure sensor is a first swing circuit pressure sensor, wherein the hydraulic circuit further includes the second hydraulic motor, wherein the circuit pressure is a first circuit pressure of fluid flowing through the hydraulic circuit in a first direction, wherein the excavator comprises a second swing circuit pressure sensor to sense a second circuit pressure of fluid flowing through the hydraulic circuit in a second direction opposite the first direction, and wherein the controller is configured to adjust, with the pilot pressure override valve, the supply pressure based on at least one of the sensed swing speed signal, the first circuit pressure, or the second circuit pressure.

4. The excavator of claim 1, further comprising:

an engine configured to drive the hydrostatic pump.

5. The excavator of claim 1, wherein the controller is configured to, based on the sensed swing speed signal, the circuit pressure, a commanded swing speed signal from the one or more input components, and a torque signal from the one or more input components:

adjust, with the pilot pressure override valve, the supply pressure to cause the pilot pressure actuator to adjust the displacement of the hydrostatic pump.

6. The excavator of claim 1, wherein the one or more input components comprise:

a first input component configured to generate a directional swing signal based on directional operator input and a commanded swing speed signal based on swing speed operator input; and a second input component configured to generate a torque signal.

7. An excavator, comprising:

a swinging element;

a swing speed sensor configured to generate, based on a swing speed of the swinging element, a sensed swing speed signal;

a hydraulic motor configured to drive the swinging element;

a hydrostatic pump to provide, at a flow rate, a fluid to the hydraulic motor, wherein the hydrostatic pump has a displacement;

a swing circuit pressure sensor to sense a circuit pressure of a hydraulic circuit including the hydraulic motor and the hydrostatic pump;

a pilot pressure actuator to control, based on a supply pressure, the displacement of the hydrostatic pump;

a pilot pressure override valve to control the supply pressure;

an engine configured to drive the hydrostatic pump; and a controller configured to:

adjust, with the pilot pressure override valve and based on the sensed swing speed signal and the circuit pressure, the supply pressure;

control the engine to adjust the flow rate at which the hydrostatic pump provides the fluid; and control, based on a command signal to decrease swing speed, the hydrostatic pump and the hydraulic motor to provide a braking torque, wherein the hydrostatic pump recovers energy during the braking torque, wherein, when the swing speed decreases, the hydraulic motor provides the fluid to the hydrostatic pump, and wherein, when the hydraulic motor provides the fluid to the hydrostatic pump, the fluid drives the hydrostatic pump to provide the recovered energy to at least one of the engine or an energy storage system.

8. The excavator of claim 7, further comprising:

one or more input components configured to generate command signals to control the swinging element.

9. The excavator of claim 7, wherein the controller is configured to, based on the sensed swing speed signal, the circuit pressure, a commanded swing speed signal, and a torque signal:

adjust, with the pilot pressure override valve, the supply pressure to control, with the pilot pressure actuator, the displacement of the hydrostatic pump.

10. The excavator of claim 7, wherein the braking torque is a maximum braking torque, and wherein the particular braking torque causes at least one of a deceleration of the swinging element or a braking event.

11. The excavator of claim 7, wherein the swinging element comprises at least one of a machine body, a boom, a stick, or a tool.

* * * * *